US009650205B2

(12) United States Patent
Petkus et al.

(10) Patent No.: US 9,650,205 B2
(45) Date of Patent: May 16, 2017

(54) CHELATING SYSTEM FOR A POLYMER LINED STEEL CONTAINER

(71) Applicant: S. C. Johnson & Son, Inc., Racine, WI (US)

(72) Inventors: Matthew M. Petkus, Lake Villa, IL (US); Rahul Saxena, Racine, WI (US); Steven J. Suess, Wauwatosa, WI (US); Stacey A. Verbeten, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 24 days.

(21) Appl. No.: 14/304,305

(22) Filed: Jun. 13, 2014

(65) Prior Publication Data

US 2014/0367300 A1 Dec. 18, 2014

Related U.S. Application Data

(60) Provisional application No. 61/834,956, filed on Jun. 14, 2013.

(51) Int. Cl.

| | |
|---|---|
| ***B65D 85/84*** | (2006.01) |
| ***B65D 25/14*** | (2006.01) |
| ***C11D 3/33*** | (2006.01) |
| ***C11D 17/04*** | (2006.01) |

(52) U.S. Cl.

CPC ..... *B65D 85/84* (2013.01); *B65D 25/14* (2013.01); *C11D 3/33* (2013.01); *C11D 17/041* (2013.01)

(58) Field of Classification Search

CPC ..... B21D 39/00; B21D 51/30; B05D 1/36; B05D 7/00; B65D 85/84; B67D 5/54

See application file for complete search history.

(56) References Cited

U.S. PATENT DOCUMENTS

| | | | | |
|---|---|---|---|---|
| 3,650,831 | A | 3/1972 | Jungermann et al. | |
| 4,793,988 | A | 12/1988 | Casey et al. | |
| 4,965,063 | A | 10/1990 | Casey et al. | |
| 5,057,303 | A | 10/1991 | Casey | |
| 5,064,635 | A | 11/1991 | Casey | |
| 5,110,492 | A | 5/1992 | Casey | |
| 5,374,488 | A * | 12/1994 | Shimizu | C25D 11/38 220/62.12 |
| 5,451,470 | A * | 9/1995 | Ashary | C23C 4/02 427/419.2 |
| 5,888,598 | A | 3/1999 | Brewster et al. | |
| 5,929,004 | A | 7/1999 | Ushijima et al. | |
| 6,677,287 | B1 | 1/2004 | Willman et al. | |
| 6,767,881 | B1 | 7/2004 | Griese et al. | |
| 6,870,026 | B1 | 3/2005 | Dean | |
| 6,959,524 | B2 | 11/2005 | Altonen et al. | |
| 7,071,155 | B2 | 7/2006 | Griese et al. | |
| 7,307,053 | B2 | 12/2007 | Tasz et al. | |
| 8,067,351 | B2 | 11/2011 | Holerca et al. | |
| 8,236,744 | B2 | 8/2012 | Boyke et al. | |
| 8,283,302 | B2 | 10/2012 | Hodge et al. | |
| 8,293,696 | B2 * | 10/2012 | McLaren | C11D 3/044 510/276 |
| 2003/0198537 | A1 * | 10/2003 | Larsen | B32B 15/08 413/2 |
| 2006/0293205 | A1 | 12/2006 | Chung | |
| 2007/0225196 | A1 | 9/2007 | Kuhlman et al. | |
| 2008/0064604 | A1 | 3/2008 | Melker | |
| 2008/0223413 | A1 * | 9/2008 | Radford | C11D 17/08 134/34 |
| 2009/0176673 | A1 | 7/2009 | Hanes | |
| 2009/0264330 | A1 | 10/2009 | Bruckner et al. | |
| 2010/0093596 | A1 | 4/2010 | Tadrowski | |
| 2012/0021963 | A1 * | 1/2012 | Kneipp | C23G 1/24 510/259 |

FOREIGN PATENT DOCUMENTS

| | | | |
|---|---|---|---|
| DE | 102005004187 | A1 | 8/2006 |
| FR | 2948536 | A1 | 2/2011 |
| WO | 0144428 | A1 | 6/2001 |

* cited by examiner

*Primary Examiner* — Jake Vu
*Assistant Examiner* — Jagadishwar Samala

(57) ABSTRACT

A chelating system for inclusion in a composition at least stored in a polymer lined metal passivated steel container which provides for stability of both the composition and the container. The composition preferably is a cleaning composition including a color-changing dye or indicator. The chelating system provides for stable storage of the composition through preventing degradation of the dye/indicator over an extended storage time. The chelating system included in the composition has a low affinity for the passivation metal on the steel container which provides for stability of the polymer liner present over the passivation layer and, thus, provides for the stability of the container. A preferred combination is a cleaning composition including (a) tetrasodium iminodisuccinate as the chelant and (b) a pH sensitive color-changing dye/indicator, in combination with a PET-lined chromium passivated tin-free steel container.

14 Claims, No Drawings

CHELATING SYSTEM FOR A POLYMER LINED STEEL CONTAINER

RELATED APPLICATION

The present application claims benefit of U.S. Provisional Application Ser. No. 61/834,956 filed Jun. 14, 2013 entitled "CHELATING SYSTEM FOR A POLYMER LINED STEEL CONTAINER".

FIELD OF INVENTION

A chelating system for inclusion in a composition which is stored in a polymer lined steel container is described. The chelating system provides for stability of the composition as well as stability of the container. In a particular embodiment, the composition is a cleaning composition containing at least one surfactant and the chelating system, and the container stores and dispenses the composition. In a further embodiment, the composition includes a color-changing dye or indicator.

BACKGROUND OF THE INVENTION

Many compositions, in particular cleaning compositions, contain chelating agents to remove metal compounds from soils and water. A chelating agent serves to seize a metal ion and control it so as to make it difficult for another substance to liberate the metal ion. A commonly known and used chelating agent is ethylenediamine tetraacetic acid (EDTA). Due to the corrosive effect of an aqueous-based cleaner on the metal of a can for storing and dispensing a cleaning composition, the interior metal surface of the can is subjected to passivation so as to shield the surface from the effects of certain materials, such as water. Passivation serves to strengthen and preserve the metal surface by providing a coating of metal and/or metal oxide to the surface to create a shell against corrosion. Nickel and chromium are two known metals used in the passivation of steel cans.

Cleaning compositions further often include components which can be unstable or degrade after an extended period of time, such as one or more dyes. As a further safeguard to aid or increase longevity of the composition stored in the container, the interior surface wall of the container can be lined with a polymer, such as polyethylene terephthalate (PET) or polypropylene (PP).

Applicants have determined, however, that chelating agents can have a detrimental effect on the polymer liner and thereby a detrimental effect on the stability of the composition.

SUMMARY OF INVENTION

A chelating system is described for inclusion in a composition which, when maintained for at least storage in a polymer lined passivated steel container, does not detrimentally affect the polymer liner resulting in a stable composition as well as a stable container. This is in particularly advantageous when the composition containing the chelating system is a cleaning composition, in particular a cleaning composition further including an ingredient subject to instability over an extended storage time, such as a color-changing dye or indicator, and more specifically preferably a pH-sensitive color-changing dye or indicator.

DETAILED DESCRIPTION OF THE INVENTION

In a first embodiment, a chelating system for inclusion in a composition is provided in combination with a polymer-lined passivated steel container, preferably a steel container free of a tin coating. While aluminum is also used in aerosol can production, such is not preferred with high pH formulas since these formulas will rapidly corrode aluminum.

In a further embodiment, the composition including the chelating agent is a cleaning composition including at least one surfactant.

In a further embodiment, the cleaning composition further includes in addition to the at least one surfactant, a color-changing dye or indicator, wherein the dye/indicator is preferably a pH-sensitive color-changing dye or indicator. When a color-changing dye or indicator is present, a tin-coated steel container is not suitable for use since the tin interferes with the color-changing dye/indicator. Tin-coated steel containers are suitable for many alkaline cleaners or formulas without a color-change dye or indicator. When a color change dye/indicator is present, however, the tin coating on the container can interfere with the dye/indicator in an irreversible oxidation/reduction reaction which causes the dye/indicator to lose color.

The container of the combination includes a steel wall with an exterior surface and interior surface. The steel container is preferably a tin-free steel container, i.e., does not have a tin coating on the interior surface. When the container is referred to herein as a "steel container", such is to be understood to include "tin-free steel container" unless otherwise noted. The interior surface has a metal passivation layer thereon. The passivation metal is one of chromium, nickel, and titanium. Other metals are considered possible for use but are not commercially available for use at this time. The chromium is generally chromium (VI) or chromium (III). These are the most commonly used since they are both the cheapest and most effective. The nickel is generally nickel (II). The passivation layer can be composed of a metal layer, or a metal layer and a metal oxide layer, wherein the metal of these layers is the passivation metal. Accordingly, for example, the metal passivation layer can be a chromium layer on the interior surface of the steel container or can be a chromium oxide layer on a chromium layer on the interior surface of the steel container.

A polymer liner is present over the metal passivation layer. The polymer liner can be composed of a polymer film conventional for such use in the container art, such as polyethylene terephthalate (PET) or polypropylene (PP) or epoxy. PET is preferred. Other polymer liners available include polyamide-imide (PAM), and modified polyesters. These latter liners are currently used commercially with aluminum containers, however, rather than steel containers.

The chelating system provides stability as to the container structure and, thus, to the composition containing the chelating system contained in the polymer lined steel container. It has been determined that certain chelating agents can negatively affect the liner of a passivated steel container. This negative affect presents itself in the delamination of the polymer liner from the interior surface of the container which in turn can then no longer provide for extended or long term stability of the composition contained in the steel container, in particular as to environment sensitive ingredients in the composition. The chelating system is composed of a chelant which has a low affinity for the metal of the metal passivation layer, i.e., the chelant has an affinity for the passivation metal which is sufficiently low so as not to react or complex with the passivation metal and, therefore, not cause delamination of the polymer liner from the interior surface of the steel. When the chelant has a high affinity for the metal of the metal passivation layer, the chelant reacts or complexes with the metal of the passivation layer which results in the delamination of the polymer liner from the passivation layer and, thus, from the interior surface of the steel container. In theory, without being bound thereto, chelating agents having a low affinity for the passivation metal can be characterized in relation to the stability constants of the metal ligand complexes formed, also known as Log k values. Chelates having Log k values below 12 for the metal used in the passivation process of the steel to make the container is an alternative manner of describing the low affinity of the chelating agent for the passivation metal. Log k values above 12 are believed to characterize chelates which have a stronger interaction with the passivation metal and are more likely than to destroy the polymer liner of the container. Stability constants for various ligands are available at—A. E. Martell, R. M. Smith, *National Institute of Standards and Technology* (NIST) *Critically Selected Stability Constants of Metal Complexes* (NIST standard reference database 46).

As to particular chelants suitable for use in the chelating system, tetrasodium iminodisuccinate has low affinity for chromium and 2-hydroxyethyliminodiacetic acid (HEIDA) has a low affinity for nickel and chromium. Ethylenediamine tetraacetic acid has a low affinity for chromium, but does not have a low affinity for nickel. Polyaspartic acid (PASP) has a Log k value of 7.5 for chromium so theoretically PASP should also be suitable for use. Other chelants which can be considered for use based on the above parameters include [S,S]-ethylene diamine disuccinic acid (EDDS), methylglycinediacetic acid (MGDA), L-glutamic acid, N,N-diacetic acid (GLDA), carboxymethyl inulin (CMI), phosphonates, sodium gluconate, trisodium citrate/tripotassium citrate, methylimino-(N,N)-diacetic acid (MIDA), L-aspartic acid-N,N-diacetic acid tetrasodium salt (ASDA), and tetrasodium 3-hydroxy-2,2'-iminodisuccinate (HIDS).

The combination chelating system and polymer lined passivated steel container as described herein is in particular suitable for use with a cleaning composition containing the chelating system together with at least one surfactant and other ingredients of the cleaning composition, especially wherein at least one ingredient of the cleaning composition (not including the chelating system) requires the presence of a polymer liner on a passivated steel container to have a stable, i.e., extended, shelf or storage life. One such particular ingredient is a color-changing dye or indicator, and more specifically a pH-sensitive color-changing dye or indicator.

A color-changing dye or indicator is a compound which is used to indicate a change in status in relation to the composition containing the dye/indicator. For example, in a cleaning composition the composition can be provided with a first color which changes to a second color following application to a surface to be cleaned to indicate, for example, that sufficient contact time has occurred to provide adequate cleaning of the surface. Alternatively, the cleaning composition may have a first color upon dispensing and a second color upon movement over a surface to be cleaned to indicate working of the cleaner.

Color-changing dyes or indicators suitable for use in a composition containing the chelating system as described above include any compound or chemical capable of changing color to provide a color-changing cleaning composition. The color change process can be achieved by various mechanisms or different agents and include natural ingredients, synthetic colorants, pH-sensitive dyes (acid-base indicators), oxidation-reduction indicators, luminescent indicators, thermochromic indicators, photochromic indicators, piezochromic indicators, encapsulated colorants, and the like as otherwise known for such color-changing use.

Preferred color-changing dyes or indicators for use in cleaning compositions are pH-sensitive dyes or acid-base indicators. Examples of such dyes suitable for use include thymolphthaleins, carvacrophthalein, o-cresolphthalein, o-cresolphthalein complexon, dixylenophthalein, guaiacolphthalein, α-naphtholphthalein, henolphthalein, phenolphthalein, disodium tetrabromophenolphthalein, xylenolphthalein, and mixtures thereof. Specific examples of the above and other color-changing dyes and indicators known in the art and suitable for use herein are disclosed in U.S. patent application Ser. No. 2009/0176673 A1, which is incorporated herein by reference. The preferred color-changing dyes are thymol-phthaleins.

Preferred cleaning compositions suitable for use in the present invention include at least one surfactant, at least one solvent, at least one pH-adjuster, water, additives as known in the art for inclusion in a cleaning composition (e.g., fragrances, odor eliminators, corrosion inhibitors, anti-bacterials, anti-microbials, preservatives, and the like), as well as the chelating system and a color-changing dye or indicator.

The surfactant can be anionic, nonionic, cationic, amphoteric, zwitterionic or mixtures thereof. When a color-changing dye is present, since the color-changing dye has a negative charge, it is not preferred to include a cationic surfactant in the composition. In such instance, an anionic and/or zwitterionic surfactant will be preferred for inclusion.

Examples of anionic surfactants suitable for use include, but are not limited to, alkyl sulfates, alkyl alkoxy sulfates, alkyl ether sulfates, alkyl sulfonates, alkyl aryl sulfonates, alkyl ester sulfonates, alkyl sulfosuccinates, alkyl ether sulfosuccinates, alkyl amido sulfosuccinates, alkyl carboxylates, and salts thereof, and the like.

Examples of nonionic surfactants suitable for use include, but are not limited to, one or more of polyhydroxy compounds, polyalkyloxy compounds, alkylene oxides, amine oxides, alkyl alkoxylated alcohols, amides, alkanolamides, alkyl glycosides, and salts thereof, and the like. Preferred nonionic surfactants for use are branched and/or linear $C_8$-$C_{12}$ alkyl alkoxylates, more preferably wherein the alkoxylation is based on 4-12 moles of ethoxylation or 4-12 moles of propoxylation.

Examples of cationic surfactants suitable for use include, but are not limited to, one or more of fatty amines, fatty diamines, polyamines, quaternary ammonium compounds, and salts thereof, and the like.

Examples of amphoteric or zwitterionic surfactants suitable for use include, but are not limited to, one or more of amphocarboxylates, alkylamino dipropionates, alkyl betaines, alkylamido betaines, sulfobetaines, alkyl sultaines, alkyl amido sultaines, sacrosinates, amphoacetates, and salts thereof, and the like.

Solvents suitable for use include glycols, alkylene glycols, and alkylene glycol ethers. Preferred solvents are ethylene glycol ethers and propylene glycol ethers having a carbon length of $C_4$-$C_8$, and can include isometric and aromatic glycol ethers.

pH adjusters suitable for use can be acidic and/or basic in nature. Acidic pH adjusters include carboxylic acids, such as citric acid, lactic acid, formic acid, acetic acid, acids with a carbon chain length of $C_1$-$C_4$, and mixtures thereof. Basic pH adjusters include alkali metal hydroxides, ammonia, amines with a carbon chain length of $C_2$-$C_5$, and mixtures thereof. pH's suitable for use are in a range of about 7 to about 14. A more preferred pH range is of about 11.9 to 12.6.

When a pH-sensitive dye or indicator is used, the pH of the composition will be determined by the pH sensitivity of the color-changing dye or indicator selected. Preferred color-changing indicators or dyes for use in cleaning compositions provide a color change between pH 7 and pH 14 and, more preferably, include both aromatic and cyclic as well as straight chain pH indicators. Preferred color-changing indicators are thymol blue, thymolphthalein, phenolphthalein, o-cresolphthalein, bromocresol green, with thymolphthalein being the most preferred.

A general representative formula of a cleaning composition suitable for use in the invention is as follows:

| Components | Wt. % |
|---|---|
| Water | about 60-about 98 |
| Solvent(s) | about 0.25-about 10 |
| Surfactant(s) | 0-about 10 |
| Color-Change Indicator/Dye | 0-about 1 |
| Chelant | 0.5-about 20 |
| Additives | 0-about 3 |
| Hydrocarbon Propellant | about 5 to about 10 |

In the above formula, a pH adjuster will be included as needed to obtain a desired pH as described above. Further, a preferred range for the color-change indicator/dye is about 0.03 to about 1 wt. %.

The composition is based on 100 wt. %. Accordingly, the components present in the composition are selected and used in an amount to provide 100 wt. %.

A preferred exemplary formula for a cleaning composition for use in a polymer lined passivated steel container (preferably a PET lined chromium passivated tin-free steel container) is as follows:

| Components | Wt. % |
|---|---|
| Sodium Hydroxide (50% Solution) | 0.1 |
| Deionized Water | 81 |
| Diethylene Glycol Butyl Ether | 6 |
| Alkyloxypolyethyleneoxyethanol | 0.75 |
| Thymolphthalein | 0.05 |
| Fragrance | 0.1 |
| Tetrasodium Iminodisuccinate (34% Solution) | 12 |
| | 100% |

Final pH = 12.3

The composition of the above formula in an amount of 94 wt. % is then provided in a polymer lined chromium passivated steel container with 6 wt. % of an A-31 (isobutane) propellant.

To illustrate the significance of the Log k values in relation to the chelates and their affinity for a passivation metal, certain testing was conducted which is described below. As set forth above, the Log k value is one way to characterize the affinity of a chelate to the passivation metal of the passivation layer on an interior wall of a steel can. Chelates having a Log k value below 12 for the metal used in the passivation process of the steel have a low affinity for the passivation metal and, therefore, the polymer liner will not be destroyed thereby.

Tests were conducted wherein nickel complexation by EDTA, BAYPURE CX 100 (tetrasodium imminodisuccinate, 34% solution, manufactured by Lanxess) and HEIDA was performed.

Complexometric titrations of nickel with 0.1 molar solutions of EDTA (Titriplex III), BAYPURE CX 100 and HEIDA as run used a standard titration method for the quantitative analysis of nickel against murexide as the color indicator.

Generally, a standard method of complexometric titration of EDTA for the titration of nickel is as described below (from http://www.titrations.info/EDTA-titration-nickel).

Nickel is titrated with EDTA against murexide. At the beginning of the titration, the solution should have a low ammonia concentration which increases near the end point. This procedure enhances color change at the end point. Reaction between EDTA and $Ni^{2+}$ ions is relatively slow, so titration should be carried out slightly slower than in other direct EDTA determinations. EDTA reacts in the same conditions with $Cu^{2+}$ and $CO^{2+}$ as well. They should be removed or masked before the titration. The reaction which takes place during titration is as follows:

$$Ni^{2+}+EDTA^{4-}\rightarrow NiEDTA^{2-}$$

For a 0.01 M titrant and a 50 mL burette, the aliquot taken for titration contains about 0.35 to 0.45 millimoles of nickel (20 to 26 mg). The end point of nickel titration is easily detected with murexide. To perform titration, a titrant of 0.01 M EDTA solution, 10% ammonium chloride and concentrated ammonium solution 100 mg of an indicator plus 20 g of analytical grade NaCl.

The procedural steps are as follows:

Transfer nickel solution to Erlenmeyer flask.

Dilute to about 100 mL with distilled water.

Add 5 mL of 10% ammonium chloride and ammonia to obtain pH around 8.

Add a pinch of murexide ground with sodium chloride (100 mg of indicator plus 20 g of analytical grade NaCl).

Titrate slowly with EDTA solution.

Just before the end of the titration, add 10 mL of concentrated ammonia solution.

Continue slow titration until the solution color changes from yellow to violet.

Calculation of EDTA titration results is straight forward since EDTA reacts with all metal ions in a 1:1 ratio:

$$Ni^{2+}+EDTA^{4-}\rightarrow NiEDTA^{2-}$$

which means that the number of moles of nickel is exactly that of the number of moles of EDTA used.

As to the specific tests carried out for the invention of EDTA, BAYPURE CX 100 and HEIDA as to nickel complexation, the pH was adjusted to 11.65 to convert all nickel into the corresponding nickel-ammonia complex. At the end of the titration point, the color of the murexide changes from yellow, or yellow-orange to dark blue.

An aqueous solution of 110 mg nickel in 1 liter of water [550 mg $Ni(NO_3)_{2x}6H_20$] was prepared. For titration, 100 ml of ammonia solution, being equivalent to 11 mg nickel-(II) was used. The consumption of 0.1 molar EDTA solution was 1.872 ml, being equivalent to 10.99 mg/100 ml (−0.1% nickel (factor 5.871). In contrast to EDTA, the consumption for a 0.1 molar BAYPURE CX 100 solution was 1.917 ml. This indicates that BAYPURE CX 100 is a slightly weaker chelating agent for nickel, which is also reflected by the Log k value of EDTA and BAYPURE CX 100 at pH 11 and pH 12. In the case of the 0.1 molar HEIDA solution, 5.869 ml was needed to get a color change from yellow or yellow-orange to violet and an additional 4.6 ml was added to turn the color dark blue (total 10.469 ml). So HEIDA appeared to be a very weak chelating agent for nickel at pH 11.65

With respect to nickel-passivated cans, it can be expected that EDTA and BAYPURE CX 100 forces nickel removal, if the nickel metal itself is not stable against the cleaning solution at pH 12. It is noted that EDTA and BAYPURE CX 100 can only chelate nickel-(II) and not nickel-(0). The summary of the results is set forth in Table A below.

TABLE A

Nickel (II) Titration With 0.1 Molar EDTA/BAYPURE CX 100/HEIDA
Weighted sample: 11.0 mg/100 ml
Nickel-(II) in deionized water [as $Ni(NO_3)_{2x}6H2O$]
pH: 11.65 (titration method requires >10.5)

| | EDTA | BAY PURE CX | HEIDA | |
|---|---|---|---|---|
| Consumption [ml] | 1.872 | 1.917 | 5.896 | 10.469 |
| Factor | 5.871 | | | |
| Result [mg/100 ml] | 10.99 | | | |
| Deviation [mg/100 ml] | 0.01 | | | |
| Observation | Sharp endpoint | Sharp endpoint | Violet | Blue |
| Log k value @ pH 11 | 16.81 | 10.53 | — | |
| Log k value @ pH 12 | 15.89 | 9.59 | — | |
| Average | 16.35 | 10.06 | — | |

Result
Nickel-(II) complexation EDTA > BAYPURE CX >>> HEIDA

Storage of the cleaner formulations at 50° C. (122° F.) for four weeks in nickel passivated cans wherein the cleaning formulation was the same except for six different chelating solutions as listed below were used:

(1) BAYPURE CX 100 as sold (34% solution of tetrasodium iminodisuccinate)
(2) (1)+Citric Acid for pH adjustment
(3) 10% solution of BAYPURE CX 100
(4) HEIDA
(5) HEIDA and Citric Acid for pH adjustment
(6) 10% solution of HEIDA

TABLE B pH Development of Nickel Passivated Cans
Storage conditions = 50° C. (122° F.) for 28 days

| | Sample | | | | | |
|---|---|---|---|---|---|---|
| pH after x days | (1) | (2) | (3) | (4) | (5) | (6) |
| 0 | 10.89 | 9.08 | 10.50 | 11.72 | 9.07 | 11.32 |
| 14 | 10.43 | 8.97 | 10.29 | 10.04 | 9.02 | 11.22 |
| 28 | 10.29 | 8.95 | 10.15 | 9.84 | 8.95 | 10.28 |
| Delta pH 0-28 | 0.6 | 0.13 | 0.36 | 1.88 | 0.12 | 1.04 |

The results were as follows:

(1) The HEIDA formulation (4) showed a pH run of nearly 2 pH units whereas the pH of the BAYPURE CX 100 formulation (1) only dropped by 0.6 pH units.
(2) As expected citrate acted as a buffer with the citric acid containing formulations.
(3) The pH reduced formulations with citrate changed color from blue to yellow immediately.
(4) All cleaning formulations (with and without citric acid) separated into two phases after heating up to 50° C.
(5) After pouring the formulations into a beaker, all formulations showed turbidity which disappeared within approximately 2½ hours during cooling down. It was initially thought that this might be the result of the formation of an organic phase based on terephthalic acid or shorter chains of PET but it was found that the formulations also separated in glass bottles within 15-20 minutes after heating up to 50° C.
(6) All cleaning formulations showed a color fading (BAYPURE CX 100 based: slightly blue/HEIDA based: turned to slightly yellow). This is believed to be effected by the pH since a pH of (2) and (5) immediately turned to yellow (pH <10) and (1) remained slightly blue (pH >10) whereas (4) turned to yellow (pH <10).

The interior of the cans were viewed using an endoscope. All cans were in good shape except the can that contained HEIDA only. In that instance, some red-brownish spots were observed in the corner of the bottom of the can and the side wall. It seems that especially in the corner, along the flare tube end of the bottom PET-pimples were observed along this corner in a minimum of 30% of the bottles. It is considered if they contained BAYPURE-based products or HEIDA-based products. The PET in this region is much thinner as compared to the side walls or the bottom, or that the PET is under tension with respect to the sharp corner.

Exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. Composition in combination with a steel container for at least storing said composition, comprising:

(a) a composition including about 0.5 to about 20 wt. % of a chelating system, about 0.25 to about 10 wt. % of at least one solvent, and about 60 to about 98 wt. % water; and (b) a steel container structured and arranged to at least store said composition;

wherein said container comprises an interior steel wall including thereon (1) a metal passivation layer comprising (i) a metal layer or (ii) a metal layer and metal oxide layer and (2) a polymer liner over said metal passivation layer;

wherein said chelating system includes a chelating agent which has an affinity to metal of said metal passivation layer such that said affinity is sufficiently low so as not to complex with said metal so as to delaminate said polymer liner from said metal passivation layer, wherein said interior steel wall does not have a tin coating thereon.

2. The combination of claim 1, wherein said container is structured and arranged to store and dispense said composition.

3. The combination of claim 1, wherein said composition is a cleaning composition containing at least one surfactant.

4. The combination of claim 1, wherein said composition further includes a color-changing dye or indicator.

5. The combination of claim 4, wherein said color-changing dye indicator is a pH sensitive dye or indicator.

6. The combination of claim 1, wherein said polymer liner comprises polyethylene terephthalate.

7. The combination of claim 1, wherein said polymer liner comprises polypropylene.

8. The combination of claim 1, wherein said chelating agent is 2-hydroxyethylimino diacetic acid and said metal of said metal passivation layer comprises chromium or nickel.

9. The combination of claim 1, wherein said chelating agent is tetrasodium iminodisuccinate, and said metal of said metal passivation layer is chromium.

10. The combination of claim 3, wherein said chelating agent is tetrasodium iminodisuccinate, and said metal of said metal passivation layer is chromium.

11. The combination of claim 10, wherein said cleaning composition further comprises at least one solvent and at least one pH-sensitive color-changing dye or indicator, wherein said composition has a pH of about 7 to about 14.

12. The combination of claim 11, wherein said pH-sensitive color-changing dye or indicator comprises a thymolphthalein.

13. The combination of claim 11, wherein said polymer liner is PET.

14. The combination of claim 1, wherein said chelating agent has a Log k value below 12 for the metal of said metal passivation layer.

* * * * *